US012303972B2

(12) United States Patent
Yun

(10) Patent No.: US 12,303,972 B2
(45) Date of Patent: May 20, 2025

(54) EJECTING DEVICE FOR DIE CASTING

(71) Applicants: Hyundai Motor Company, Seoul (KR); Kia Corporation, Seoul (KR)

(72) Inventor: Soonhyun Yun, Ulsan (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 18/762,947

(22) Filed: Jul. 3, 2024

(65) Prior Publication Data

US 2025/0083220 A1 Mar. 13, 2025

(30) Foreign Application Priority Data

Sep. 8, 2023 (KR) ..... 10-2023-0119484

(51) Int. Cl.
*B22D 17/20* (2006.01)
*B22D 17/00* (2006.01)

(52) U.S. Cl.
CPC ..... *B22D 17/2084* (2013.01); *B22D 17/002* (2013.01)

(58) Field of Classification Search
CPC ..... B22D 17/2084; B22D 17/002; B22D 17/2236
See application file for complete search history.

(56) References Cited

U.S. PATENT DOCUMENTS

2013/0340968 A1* 12/2013 Sugiura ..... B22D 17/2236 164/302

* cited by examiner

*Primary Examiner* — Kevin P Kerns
*Assistant Examiner* — Steven S Ha
(74) *Attorney, Agent, or Firm* — Slater Matsil, LLP

(57) ABSTRACT

An embodiment ejecting device for die casting for use in ejecting a molded product molded by a fixed die and a movable die, the ejecting device including an ejecting plate disposed on a movable holder on which the movable die is mounted to be movable forward and backward in a moving direction of the movable die, a plurality of main ejecting pins disposed on the ejecting plate in the moving direction of the movable die to penetrate through the movable die, and a plurality of sub-ejecting units disposed on the ejecting plate to penetrate through the movable die and disposed to eject the molded product in multiple directions within a set ejecting angle range based on an arrangement direction of the main ejecting pins.

20 Claims, 10 Drawing Sheets

EJECTING DEVICE FOR DIE CASTING

CROSS-REFERENCE TO RELATED APPLICATIONS

This application claims the benefit of Korean Patent Application No. 10-2023-0119484, filed on Sep. 8, 2023, which application is hereby incorporated herein by reference.

TECHNICAL FIELD

An exemplary embodiment of the disclosure relates to a die casting system.

BACKGROUND

In general, a die casting method is a method of injecting molten metal into a mold at high pressure to solidify the molten metal into a solid state and manufacturing a product having a set shape.

The mold used in such a high-pressure die casting method includes a fixed die and a movable die that may be combined and released.

When molten metal is injected into a cavity formed between the fixed die and the movable die combined together, the molten metal solidifies within the cavity and may be molded into a product having a desired shape.

Furthermore, the movable die includes an ejecting device for ejecting the molded product.

The ejecting device includes an ejecting plate movably installed on the movable die in a moving direction of the movable die and a plurality of ejecting pins mounted on the ejecting plate.

Here, the number and mounting positions of the ejecting pins may be determined by an operating force of the ejecting plate and a pressing force (or compression force) of the ejecting pins applied to the molded product. These ejecting pins are arranged parallel to each other in the moving direction of the movable die on the ejecting plate.

Therefore, in a state in which the fixed die and the movable die are released, when the ejecting plate moves in the moving direction of the movable die, the molded product may be ejected from the movable die by the operation of the ejecting pins.

However, the ejecting pins may be bent or damaged due to buckling. As a result, unavailability of the mold may increase and the occurrence of defects of molded products may increase.

The above information disclosed in this background section is only for enhancement of understanding of the background of the disclosure, and therefore it may contain information that does not form the already known prior art.

SUMMARY

An exemplary embodiment of the disclosure relates to a die casting system. Particular embodiments relate to an ejecting device for die casting configured to eject a product molded by a high pressure die casting method from a mold.

Embodiments of the disclosure provide an ejecting device for die casting capable of preventing damage and breakage of ejecting pins due to buckling.

According to an exemplary embodiment of the disclosure, an ejecting device for die casting, which is configured to eject a molded product molded by a fixed die and a movable die, includes: i) an ejecting plate installed on a movable holder on which the movable die is mounted to be movable forward and backward in a moving direction of the movable die; ii) a plurality of main ejecting pins installed on the ejecting plate in the moving direction of the movable die to penetrate through the movable die; and iii) a plurality of sub-ejecting units installed on the ejecting plate to penetrate through the movable die and disposed to eject the molded product in multiple directions within a set ejecting angle range based on an arrangement direction of the main ejecting pins.

In the ejecting device for die casting according to an exemplary embodiment of the disclosure, at least one of the plurality of sub-ejecting units may be disposed at an ejecting angle according to the arrangement direction of the main ejecting pins.

In the ejecting device for die casting according to an exemplary embodiment of the disclosure, at least another one of the plurality of sub-ejecting units may be disposed at an ejecting angle inclined in a diagonal direction with respect to the arrangement direction of the main ejecting pins.

In addition, according to an exemplary embodiment of the disclosure, an ejecting device for die casting, which is configured to eject a molded product molded by a fixed die and a movable die, includes: i) an ejecting plate installed on a movable holder on which the movable die is mounted to be movable forward and backward in a moving direction of the movable die; ii) a plurality of main ejecting pins installed on the ejecting plate in the moving direction of the movable die to penetrate through the movable die; iii) at least one first sub-ejecting unit installed on the ejecting plate to penetrate through the movable die and disposed at an ejecting angle according to an arrangement direction of the main ejecting pins; iv) at least one second sub-ejecting unit installed on the ejecting plate to penetrate through the movable die and disposed to be inclined at a set ejecting angle based on the arrangement direction of the main ejecting pins; and v) a joint module installed on the ejecting plate and connected to the at least one second sub-ejecting unit so that the at least one second sub-ejecting unit is movable linearly and swingable according to movement of the ejecting plate.

Also, in the ejecting device for die casting according to an exemplary embodiment of the disclosure, the at least one first sub-ejecting unit may include a first sub-ejecting rod coupled to the ejecting plate by tapping and disposed parallel to the main ejecting pins in a moving direction of the ejecting plate and a first sub-ejecting block coupled to the first sub-ejecting rod.

Also, in the ejecting device for die casting according to an exemplary embodiment of the disclosure, the first sub-ejecting rod may be provided as a rod having a cross-sectional area larger than cross-sectional areas of the plurality of main ejecting pins.

Also, in the ejecting device for die casting according to an exemplary embodiment, the first sub-ejecting block may be provided as a block having a cross-sectional area larger than a cross-sectional area of the first sub-ejecting rod.

Also, in the ejecting device for die casting according to an exemplary embodiment of the disclosure, the first sub-ejecting rod may be coupled to the ejecting plate by tapping through a coupling end portion having a tapping thread.

Also, in the ejecting device for die casting according to an exemplary embodiment of the disclosure, the first sub-ejecting block may be coupled to a free end portion of the first sub-ejecting rod through a first dowel pin.

Also, in the ejecting device for die casting according to an exemplary embodiment of the disclosure, the first sub-ejecting block may include a first ejecting surface supporting the molded product and a first gradient portion having a cross-sectional area gradually decreasing at a set gradient angle in a longitudinal direction of the first sub-ejecting rod on the first ejecting surface.

Also, in the ejecting device for die casting according to an exemplary embodiment of the disclosure, the at least one first sub-ejecting unit may further include a first guide bush fixed to the movable holder to guide the first sub-ejecting rod.

Also, in the ejecting device for die casting according to an exemplary embodiment of the disclosure, the at least one second sub-ejecting unit may include a second sub-ejecting rod connected to the joint module through a through-hole formed in the ejecting plate and disposed to be inclined in a diagonal direction in a moving direction of the ejecting plate and a second sub-ejecting block coupled to the second sub-ejecting rod.

Also, in the ejecting device for die casting according to an exemplary embodiment of the disclosure, the second sub-ejecting rod may have a cross-sectional area larger than cross-sectional areas of the plurality of main ejecting pins.

Also, in the ejecting device for die casting according to an exemplary embodiment of the disclosure, the second sub-ejecting block may have a cross-sectional area larger than the cross-sectional area of the second sub-ejecting rod.

Also, in the ejecting device for die casting according to an exemplary embodiment of the disclosure, the second sub-ejecting rod may be coupled to the joint module through a coupling end portion to be movable linearly and swingable.

Also, in the ejecting device for die casting according to an exemplary embodiment of the disclosure, the second sub-ejecting block may be coupled to a free end portion of the second sub-ejecting rod through a second dowel pin.

Also, in the ejecting device for die casting according to an exemplary embodiment of the disclosure, the second sub-ejecting block may include a second ejecting surface supporting the molded product and a second gradient portion having a cross-sectional area gradually decreasing at a set gradient angle in a longitudinal direction of the second sub-ejecting rod on the second ejecting surface.

Also, in the ejecting device for die casting according to an exemplary embodiment of the disclosure, the second sub-ejecting block may be disposed on an undercut portion molded in the molded product and may be provided to exit the undercut portion through the second ejecting surface.

Also, in the ejecting device for die casting according to an exemplary embodiment of the disclosure, the at least one second sub-ejecting unit may further include a second guide bush obliquely fixed to the movable holder to guide the second sub-ejecting rod.

Also, in the ejecting device for die casting according to an exemplary embodiment of the disclosure, the joint module may include a fixed block fixed to the ejecting plate in a position corresponding to the through-hole and a slider coupled to the fixed block to be slidable in a straight direction and coupled so that the second sub-ejecting rod swings within a set ejecting angle range.

Also, in the ejecting device for die casting according to an exemplary embodiment of the disclosure, the second sub-ejecting rod may be swingably coupled to be swingable to the slider through a hinge pin.

According to the ejecting device for die casting according to an exemplary embodiment of the disclosure, by preventing damage and breakage of the main ejecting pins due to buckling, unavailability of the die casting system may be reduced and the occurrence of defects in molded products may be minimized.

In addition, according to the ejecting device for die casting according to an exemplary embodiment of the disclosure, the shape of an undercut portion may be implemented in molded products, thereby improving the degree of freedom in designing molded products.

In addition, effects that may be obtained or expected due to exemplary embodiments of the disclosure will be directly or implicitly disclosed in the detailed description of the disclosure. That is, various effects predicted according to the disclosure will be disclosed in the detailed description to be described below.

BRIEF DESCRIPTION OF THE DRAWINGS

The drawings are used to be referred to in describing exemplary embodiments of the disclosure, so a technical concept of the disclosure should not be meant to restrict the disclosure to the accompanying drawings.

Figure 1:
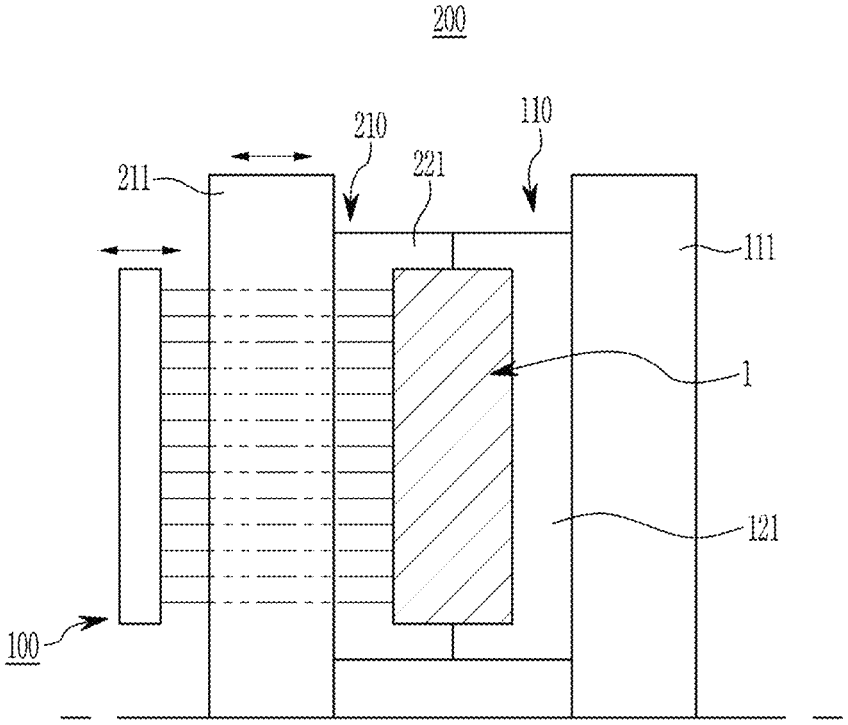
FIG. 1 is a diagram schematically illustrating a mold system to which an ejecting device for die casting is applied according to an exemplary embodiment of the disclosure.

It is to be understood that the drawings referenced above are not necessarily drawn to scale, but rather present a rather simplified representation of various preferred features illustrating the basic principles of embodiments of the disclosure. Certain design features of the embodiments of the disclosure, including, for example, particular dimensions, orientation, location, and shape, will be determined in part by the particular intended application and environment of use.

DETAILED DESCRIPTION OF ILLUSTRATIVE EMBODIMENTS

Embodiments of the disclosure will be described more fully hereinafter with reference to the accompanying drawings, in which exemplary embodiments of the disclosure are shown. As those skilled in the art would realize, the described exemplary embodiments may be modified in various different ways, all without departing from the spirit or scope of the disclosure.

In order to clarify the disclosure, parts irrelevant to the description will be omitted, and similar reference numerals are used for the similar parts throughout the specification.

The size and thickness of each element are arbitrarily illustrated in the drawings, and the disclosure is not necessarily limited thereto. In the drawings, the thickness of layers, films, panels, regions, etc. are exaggerated for clarity.

In addition, the terms "unit," "part," and "member" described in the specification mean units of comprehensive components performing at least one function and operation.

The terminology used herein is for the purpose of describing specific exemplary embodiments and is not intended to limit the disclosure. As used herein, the singular forms are also intended to include the plural forms, unless the context clearly dictates otherwise.

As used herein, it should be understood that the terms 'include' and/or 'including' refer to the presence of specified features, integers, steps, operations, elements and/or components, but they do not exclude the presence or addition of one or more other features, integers, steps, operations, components, and/or groups thereof.

As used herein, the term 'coupled' denotes a physical relationship between two components directly connected to each other or indirectly connected through one or more intervening components.

Hereinafter, exemplary embodiments of the disclosure are described in detail with reference to the accompanying drawings.

FIG. 1 is a diagram schematically illustrating a die casting system to which an ejecting device for die casting is applied according to an exemplary embodiment of the disclosure.

Referring to FIG. 1, an ejecting device 100 for die casting according to an exemplary embodiment of the disclosure may be applied to a die casting system 200 for manufacturing a molded product 1 having a desired shape by injecting molten metal of an aluminum alloy into a mold die.

In an example, the die casting system 200 may be applied to a process of molding automotive engine parts, such as cylinder blocks and cylinder heads, using a high-pressure die casting method.

In this specification, reference directions for describing the following components may be set as a vertical direction and a side direction (e.g., front-rear direction and left-right direction).

Also, in this specification, an 'upper end portion,' 'upper portion,' 'top' or 'upper surface' of a component refers to an end portion, portion, end, or surface of the component that is present relatively on the upper side in the drawings, and a 'lower end portion,' 'lower portion,' 'bottom,' or 'lower surface' of a component refers to an end portion, portion, end, or surface of the component that is present relatively on the lower side in the drawings.

In addition, in this specification, an end of a component (e.g., one end or the other end, etc.) refers to the end of the component in any one direction, and an end portion of a component (e.g., one end portion or the other end portion, etc.) refers to a certain portion of the component including the end.

Meanwhile, the die casting system 200 as described above basically includes a fixed mold 110 and a movable mold 210.

The fixed mold 110 is fixed on a base installed in a die casting process workplace. This fixed mold 110 includes a fixed holder 111 and a fixed die 121.

In an example, the fixed holder 111 may be installed upright on an upper surface of the base in the vertical direction.

The fixed die 121 is mounted on the fixed holder 111. The fixed die 121 is configured to mold a portion of the molded product 1 through a molding section.

In addition, the movable mold 210 is installed to be movable back and forth in the front-rear direction on the base to correspond to the fixed mold 110. This movable mold 210 includes a movable holder 211 and a movable die 221.

The movable holder 211 may be installed to be slidable on an upper surface of the base in the front-rear direction by driving a die driving source (not shown) known to those skilled in the art.

The movable die 221 is mounted on the movable holder 211. The movable die 221 is configured to mold another portion of the molded product 1 through a molding section. The movable die 221 may be combined with the fixed die 121 or may be released from the fixed die 121.

In the die casting system 200 configured as described above, the fixed die 121 and the movable die 221 are combined with each other, and molten metal is injected into a cavity formed between the molding section of the fixed die 121 and the molding section of the movable die 221. Then, the die casting system 200 may solidify the molten metal in the cavity and may mold the molded product 1 having the desired shape.

Meanwhile, the ejecting device 100 for die casting according to an exemplary embodiment of the disclosure ejects the molded product 1 from the movable die 221 in a state in which the fixed die 121 and the movable die 221 are released.

Figure 2:
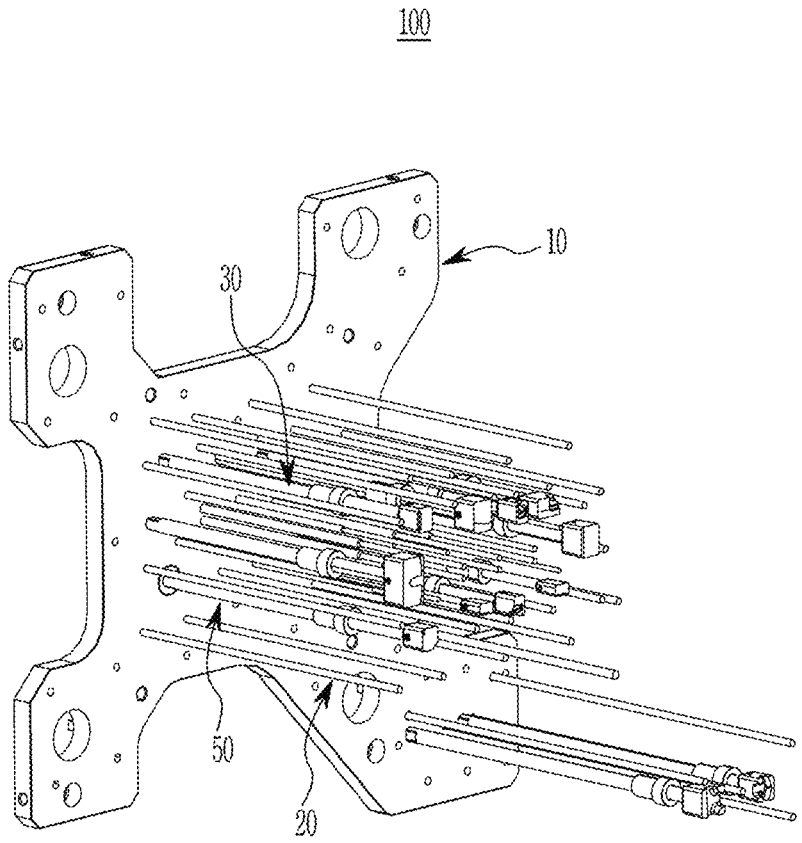
FIG. 2 is a perspective view illustrating an ejecting device for die casting according to an exemplary embodiment of the disclosure.
Figure 3:
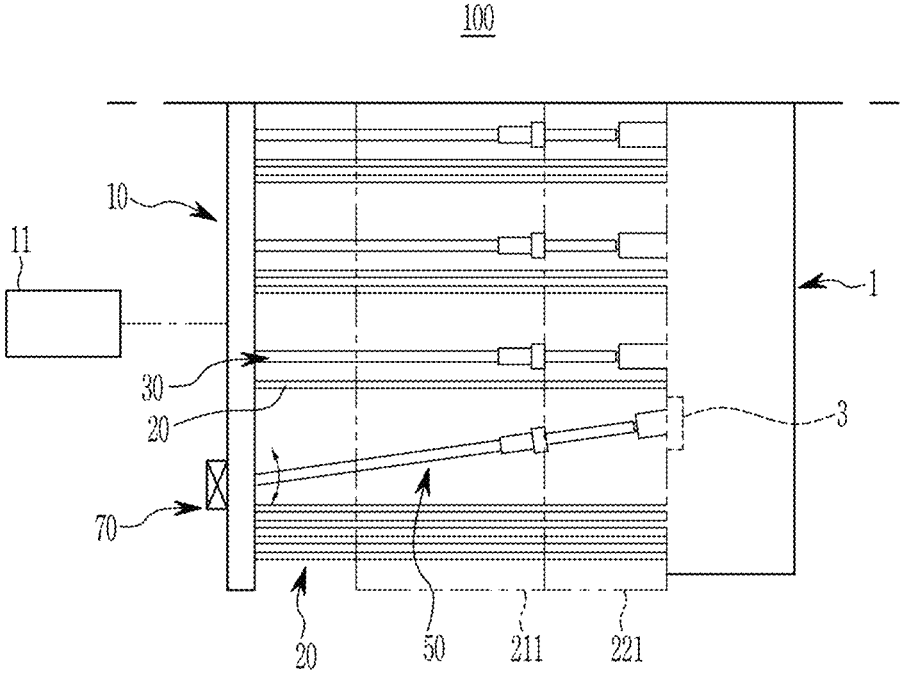
FIG. 3 is a side view illustrating an ejecting device for die casting according to an exemplary embodiment of the disclosure.

FIG. 2 is a perspective view illustrating an ejecting device for die casting according to an exemplary embodiment of the disclosure, and FIG. 3 is a side view illustrating an ejecting device for die casting according to an exemplary embodiment of the disclosure.

Referring to FIGS. 2 and 3, the ejecting device 100 for die casting according to an exemplary embodiment of the disclosure basically includes an ejecting plate 10 and a plurality of main ejecting pins 20.

The ejecting plate 10 is installed on the movable holder 211 to be able to move forward and backward in a moving direction (e.g., front-rear direction) of the movable die 221. The ejecting plate 10 may be moved forward and backward by driving the ejecting driving source 11. In an example, the ejecting driving source 11 may include a hydraulic cylinder known to those skilled in the art.

In addition, the main ejecting pins 20 are configured to push the molded product 1 in the moving direction of the movable die 221 with a set ejection force (e.g., compression force). The main ejecting pins 20 are installed on the ejecting plate 10 in the moving direction of the movable die 221 so as to penetrate through the movable die 221 through the movable holder 211.

The ejecting device 100 for die casting according to an exemplary embodiment of the disclosure has a structure that may prevent damage and breakage of the main ejecting pins 20 due to buckling.

In addition, an exemplary embodiment of the disclosure provides the ejecting device 100 for die casting that may implement a shape of an undercut portion 3 in the molded product 1.

To this end, the ejecting device 100 for die casting according to an exemplary embodiment of the disclosure further includes a plurality of sub-ejecting units 30 and 50 and a joint module 70.

In an exemplary embodiment of the disclosure, the sub-ejecting units 30 and 50 eject the molded product 1 in multiple directions and may implement the shape of the undercut portion 3 on the molded product 1. In addition, the sub-ejecting units 30 and 50 may strengthen the ejection force of the molded product 1 and disperse compression force concentrated on the main ejecting pins 20.

The sub-ejecting units 30 and 50 are installed on the ejecting plate 10 to penetrate through the movable die 221 via the movable holder 211. The sub-ejecting units 30 and 50 may be disposed to eject the molded product 1 in multiple directions within a range of ejecting angles (θ1 to θ2) (see FIGS. 5 and 8) set based on an arrangement direction of the main ejecting pins 20.

Hereinafter, among the sub-ejecting units 30 and 50, at least one is referred to as a 'first sub-ejecting unit 30,' and at least the other one is referred to as a 'second sub-ejecting unit 50.'

The first sub-ejecting unit 30 may be disposed at an ejecting angle θ1 (hereinafter, see FIG. 5) according to the arrangement direction of the main ejecting pins 20.

Figure 4:
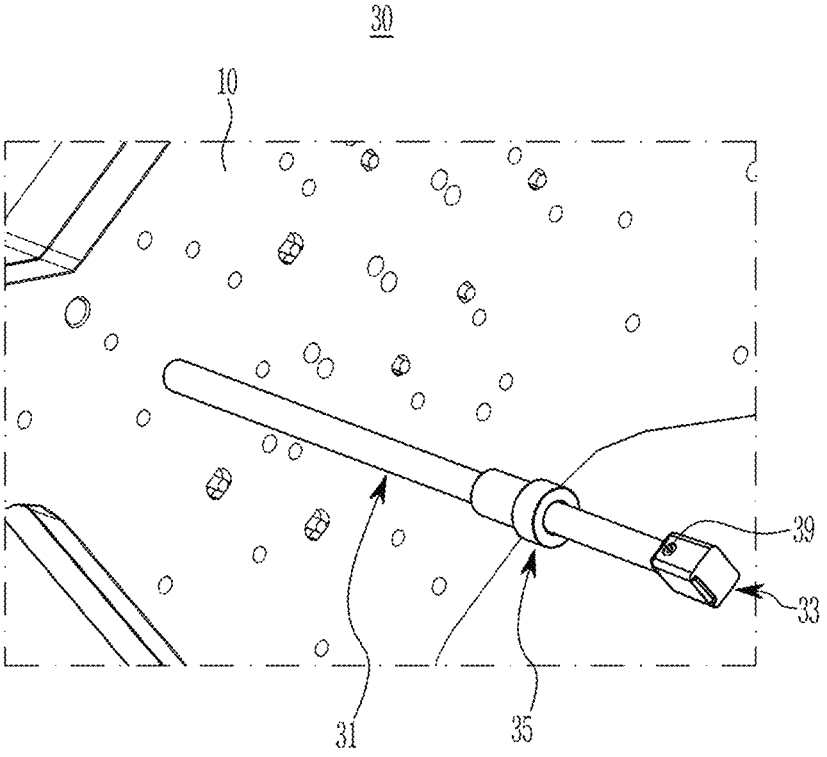
FIG. 4 is a perspective view illustrating a first sub-ejecting unit applied to an ejecting device for die casting according to an exemplary embodiment of the disclosure.
Figure 5:
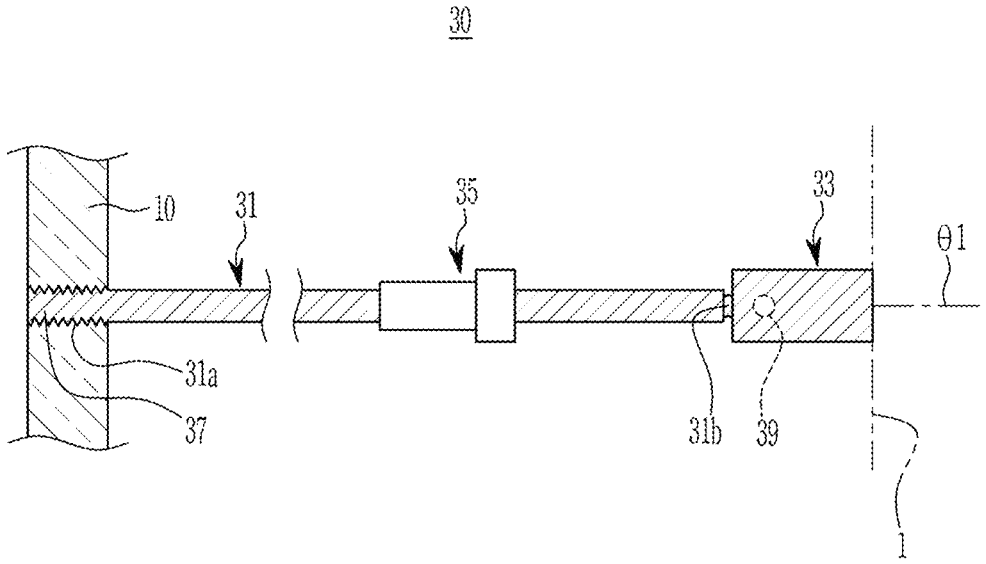
FIG. 5 is a cross-sectional view illustrating a first sub-ejecting unit applied to an ejecting device for die casting according to an exemplary embodiment of the disclosure.

FIG. 4 is a perspective view illustrating a first sub-ejecting unit applied to an ejecting device for die casting according to an exemplary embodiment of the disclosure, and FIG. 5 is a cross-sectional view illustrating a first sub-ejecting unit applied to an ejecting device for die casting according to an exemplary embodiment of the disclosure.

Referring to FIGS. 2 to 5, the first sub-ejecting unit 30 according to an exemplary embodiment of the disclosure includes a first sub-ejecting rod 31, a first sub-ejecting block 33, and a first guide bush 35.

The first sub-ejecting rod 31 is coupled to the ejecting plate 10 by tapping. The first sub-ejecting rod 31 is disposed parallel to the main ejecting pins 20 in the moving direction of the ejecting plate 10.

Figure 6A:
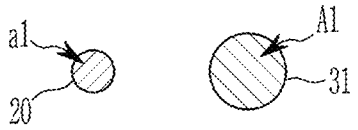
FIGS. 6A to 6C are diagrams illustrating a shape of a first sub-ejecting unit applied to an ejecting device for die casting according to an exemplary embodiment of the disclosure.

Here, the first sub-ejecting rod 31 may be coupled to the ejecting plate 10 by tapping through a coupling end portion 31*a* on which a tapping thread 37 is formed. Also, as shown in FIG. 6A, the first sub-ejecting rod 31 may be provided as a rod having a cross-sectional area A1 larger than a cross-sectional area a1 of the main ejecting pins 20.

The first sub-ejecting block 33 is configured to support the molded product 1 in the movable die 221. The first sub-ejecting block 33 is coupled to a free end portion 31*b* of the first sub-ejecting rod 31.

Figure 6B:
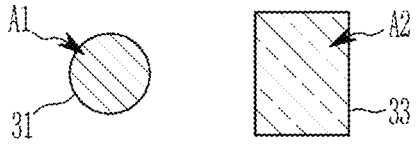

Here, the first sub-ejecting block 33 may be coupled to the free end portion 31*b* of the first sub-ejecting rod 31 through a first dowel pin 39. Also, as shown in FIG. 6B, the first sub-ejecting block 33 may be provided as a block having a cross-sectional area A2 larger than the cross-sectional area A1 of the first sub-ejecting rod 31.

Figure 6C:
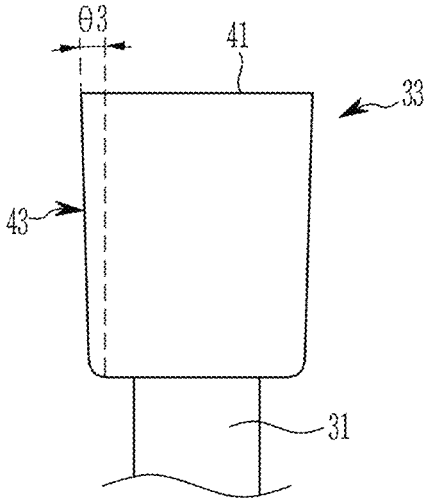

Furthermore, the first sub-ejecting block 33 includes a first ejecting surface 41 and a first gradient portion 43, as shown in FIG. 6C.

The first ejecting surface 41 is configured to support a set portion of the molded product 1.

The first gradient portion 43 is configured to prevent the first sub-ejecting block 33 from being caught in the set portion of the molded product 1.

The first gradient portion 43 may be formed to have a cross-sectional area gradually decreasing at a set gradient angle θ3 in the longitudinal direction of the first sub-ejecting rod 31 on the first ejecting surface 41.

Here, the set gradient angle θ3 may be, for example, 1°, considering thermal expansion of the first sub-ejecting block 33 as the first sub-ejecting block 33 is heated to approximately 200 to 300° C.

Also, the first guide bush 35 is configured to guide the first sub-ejecting rod 31. The first guide bush 35 is provided in a cylindrical shape and is fixed to the movable holder 211. The first guide bush 35 may be fixed to the movable holder 211 in the moving direction of the ejecting plate 10.

Referring to FIGS. 2 and 3, in an exemplary embodiment of the disclosure, the second sub-ejecting unit 50 may be disposed to be inclined at an ejecting angle θ2 (see FIG. 8) set based on the arrangement direction of the main ejecting pins 20.

The second sub-ejecting unit 50 may be disposed at the ejecting angle θ2 (for example, −7° to +7°) inclined diagonally with respect to the arrangement direction of the main ejecting pins 20.

Figure 7:
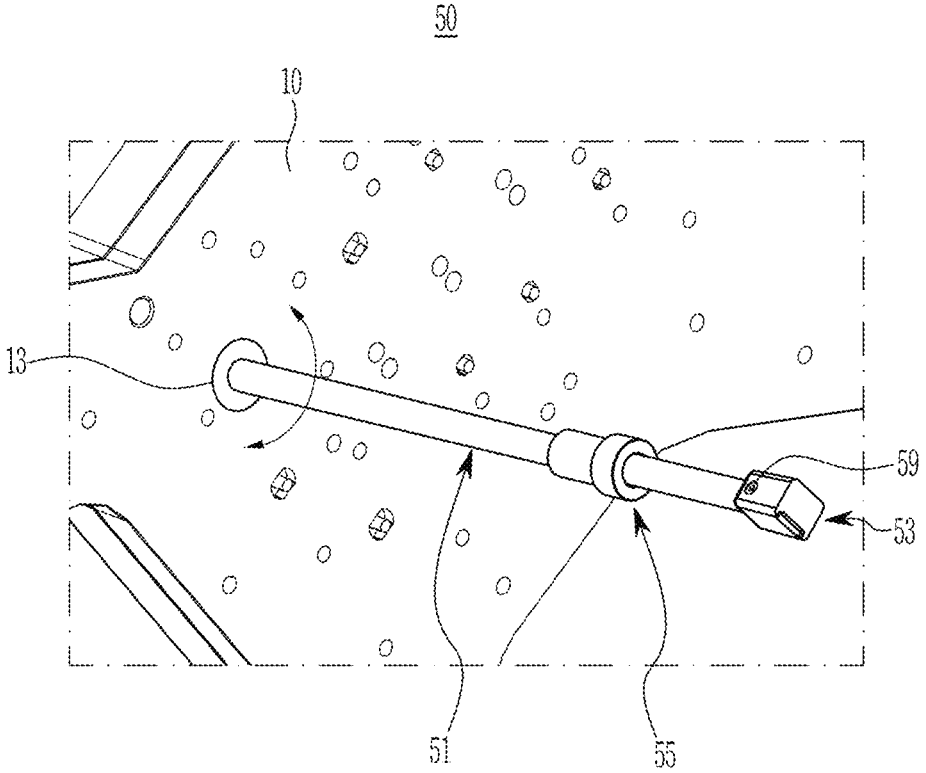
FIG. 7 is a perspective view illustrating a second sub-ejecting unit applied to an ejecting device for die casting according to an exemplary embodiment of the disclosure.
Figure 8:
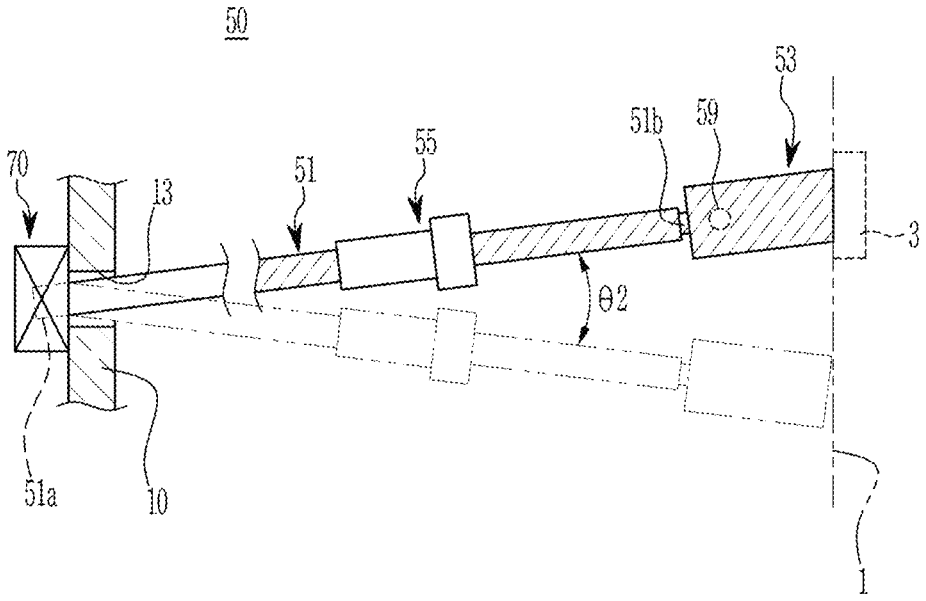
FIG. 8 is a cross-sectional view illustrating a second sub-ejecting unit applied to an ejecting device for die casting according to an exemplary embodiment of the disclosure.

FIG. 7 is a perspective view illustrating a second sub-ejecting unit applied to an ejecting device for die casting according to an exemplary embodiment of the disclosure, and FIG. 8 is a cross-sectional view illustrating a second sub-ejecting unit applied to an ejecting device for die casting according to an exemplary embodiment of the disclosure.

Referring to FIGS. 7 and 8 along with FIGS. 2 and 3, the second sub-ejecting unit 50 according to an exemplary embodiment of the disclosure includes a second sub-ejecting rod 51, a second sub-ejecting block 53, and a second guide bush 55.

The second sub-ejecting rod 51 may pass through a through-hole 13 formed in the ejecting plate 10 and be connected to the joint module 70, which will be described below. The second sub-ejecting rod 51 is disposed to be inclined diagonally based on the moving direction of the ejecting plate 10.

Figure 9A:
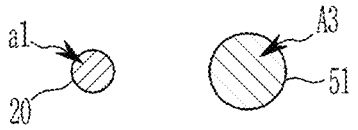
FIGS. 9A to 9C are diagrams illustrating a shape of a second sub-ejecting unit applied to an ejecting device for die casting according to an exemplary embodiment of the disclosure.

Here, the through-hole 13 may be formed as a hole having a cross-sectional area larger than a cross-sectional area of the second sub-ejecting rod 51. The second sub-ejecting rod 51 may be coupled to the joint module 70 through a coupling end portion 51*a* that penetrates through the through-hole 13 to move linearly and to be swingable. Also, as shown in FIG. 9A, the second sub-ejecting rod 51 may be provided as a rod having a cross-sectional area A3 larger than the cross-sectional area a1 of the main ejecting pins 20.

The second sub-ejecting block 53 is configured to support the molded product 1 in the movable die 221. The second sub-ejecting block 53 is coupled to a free end portion 51*b* of the second sub-ejecting rod 51.

Figure 9B:
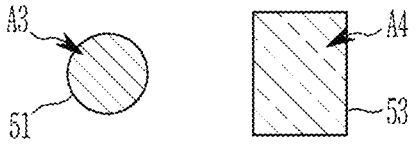

Here, the second sub-ejecting block 53 may be coupled to the free end portion 51*b* of the second sub-ejecting rod 51 through a second dowel pin 59. Also, as shown in FIG. 9B, the second sub-ejecting block 53 may be provided as a block having a cross-sectional area A4 larger than the cross-sectional area A3 of the second sub-ejecting rod 51.

Figure 9C:
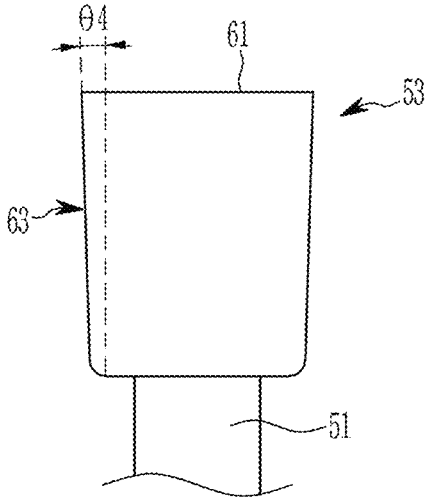

Furthermore, the second sub-ejecting block 53 includes a second ejecting surface 61 and a second gradient portion 63, as shown in FIG. 9C.

The second ejecting surface 61 is configured to support a set portion of the molded product 1.

The second gradient portion 63 is configured to prevent the second sub-ejecting block 53 from being caught in the set portion of the molded product 1.

The second gradient portion 63 may be formed to have a cross-sectional area gradually decreasing at a set gradient angle θ4 in the longitudinal direction of the second sub-ejecting rod 51 on the second ejecting surface 61.

The set gradient angle θ4 may be set to, for example, 1°, considering thermal expansion of the second sub-ejecting block 53 as the second sub-ejecting block 53 is heated to approximately 200 to 300° C.

Here, the second sub-ejecting block 53 may be disposed at an undercut portion 3 (see FIGS. 3 and 8) formed on the molded product 1. That is, the second sub-ejecting block 53 may implement the shape of the undercut portion 3 in the molding section of the movable die 221. This second sub-ejecting block 53 may be provided to exit the undercut portion 3 through the second ejecting surface 61.

Also, the second guide bush 55 is configured to guide the second sub-ejecting rod 51. The second guide bush 55 is provided in a cylindrical shape and is obliquely fixed to the movable holder 211.

The second guide bush 55 may be obliquely fixed to the movable holder 211 at an angle corresponding to a tilt angle of the second sub-ejecting rod 51.

Referring to FIGS. 3 and 8, in an exemplary embodiment of the disclosure, the joint module 70 allows the second sub-ejecting rod 51 of the second sub-ejecting unit 50 to move linearly and swing.

That is, since the second sub-ejecting rod 51 of the joint module 70 is disposed obliquely, the joint module 70 may grant the degree of freedom of linear movement and swinging according to a movement displacement of the ejecting plate 10 to the second sub-ejecting rod 51.

The joint module 70 is installed on the ejecting plate 10. The joint module 70 is connected to the coupling end portion 51*a* of the second sub-ejecting rod 51 so that the second sub-ejecting rod 51 may move linearly and swing according to movement of the ejecting plate 10.

Figure 10:
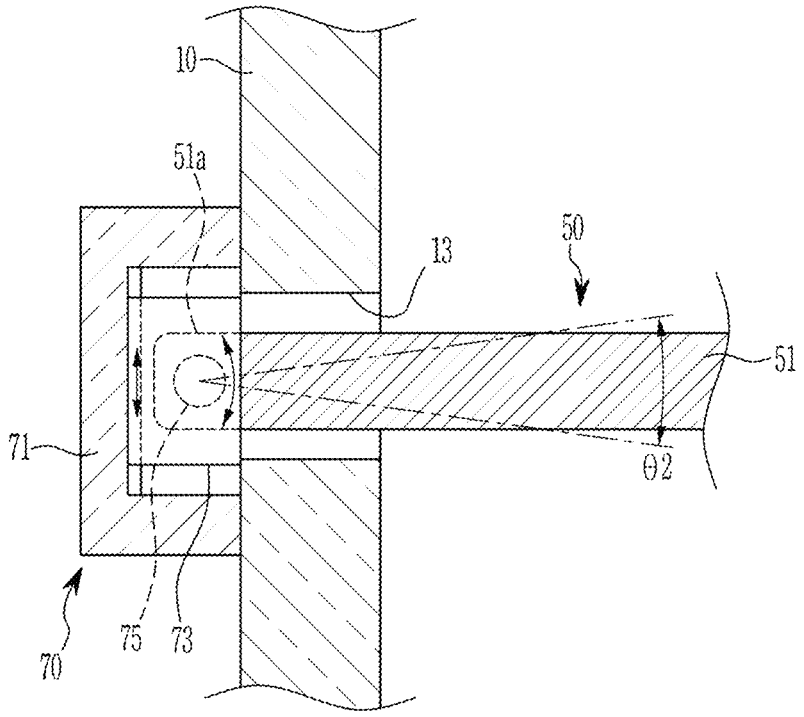
FIG. 10 is a diagram schematically illustrating a joint module applied to an ejecting device for die casting according to an exemplary embodiment of the disclosure.

FIG. 10 is a diagram schematically illustrating a joint module applied to an ejecting device for die casting according to an exemplary embodiment of the disclosure.

Referring to FIG. 10, the joint module 70 according to an exemplary embodiment of the disclosure includes a fixed block 71 and a slider 73.

The fixed block 71 is fixed to the ejecting plate 10 in a position corresponding to the through-hole 13 of the ejecting plate 10.

The slider 73 is coupled to the fixed block 71 to be slidable in a straight direction. The coupling end portion 51*a* of the second sub-ejecting rod 51 is coupled to the slider 73 to be swingable within a set ejecting angle range θ2.

Here, the coupling end portion 51*a* of the second sub-ejecting rod 51 may be rotatably coupled to the slider 73 through the hinge pin 75.

Hereinafter, the operation of the ejecting device 100 for die casting according to an exemplary embodiment of the disclosure configured as described above will be described in detail with reference to FIGS. 1 to 10.

First, in an exemplary embodiment of the disclosure, the movable mold 210 is spaced apart from the fixed mold 110 on the base in the front-rear direction.

The fixed mold 110 includes the fixed holder 111 and the fixed die 121, and the movable mold 210 includes the movable holder 211 and the movable die 221. The ejecting device 100 for die casting according to an exemplary embodiment of the disclosure is installed in the movable mold 210 described above.

The ejecting device 100 for die casting according to an exemplary embodiment of the disclosure includes the ejecting plate 10, the main ejecting pins 20, the first sub-ejecting unit 30, the second sub-ejecting unit 50, and the joint module 70.

The ejecting plate 10 is moved backward according to driving of the ejecting driving source 11. The main ejecting pins 20 are installed on the ejecting plate 10 to penetrate through the movable die 221 via the movable holder 211 and are arranged in the moving direction of the movable die 221.

The first sub-ejecting unit 30 and the second sub-ejecting unit 50 are installed on the ejecting plate 10 to penetrate through the movable die 221 through the movable holder 211.

The first sub-ejecting unit 30 includes a first sub-ejecting rod 31, a first sub-ejecting block 33, and a first guide bush 35. Also, the second sub-ejecting unit 50 includes a second sub-ejecting rod 51, a second sub-ejecting block 53, and a second guide bush 55.

Furthermore, the first sub-ejecting rod 31 is disposed at the ejecting angle θ1 according to the arrangement direction of the main ejecting pins 20 through the first guide bush 35. The first sub-ejecting block 33 is coupled to the first sub-ejecting rod 31 and is located in the molding section of the movable die 221.

Also, the second sub-ejecting rod 51 is disposed to be inclined at the set ejecting angle θ2 based on the arrangement direction of the main ejecting pins 20 through the second guide bush 55 and the joint module 70. The second sub-ejecting block 53 is coupled to the second sub-ejecting rod 51 and is located in the molding section of the movable die 221.

Here, the second sub-ejecting rod 51 is swingably coupled to the slider 73 of the joint module 70 through a hinge pin 75. In addition, the slider 73 is coupled to the fixed block 71. Also, the slider 73 is coupled to the fixed block 71 to be slidable in a straight direction.

In this state, the movable mold 210 is moved toward the fixed mold 110 by a die driving source (not shown) and is combined with the fixed mold 110.

Then, a cavity may be formed between the molding section of the fixed die 121 and the molding section of the movable die 221, molten metal may be injected into the cavity, and the molten metal solidifies to be molded as the molded product 1 having a set shape.

At this time, the molded product 1 includes the undercut portion 3 molded in a set portion. The shape of the undercut portion 3 may be implemented by the second sub-ejecting block 53 of the second sub-ejecting unit 50 in the molding section of the movable die 221. This second sub-ejecting block 53 supports the undercut portion 3.

When the molding of the molded product 1 is completed as described above, the movable mold 210 is separated from the fixed mold 110 by a die driving source (not shown). At this time, the molded product 1 is located in the movable die 221 of the movable mold 210.

Thereafter, the ejecting plate 10 moves forward according to driving of the ejecting driving source 11. Accordingly, the main ejecting pins 20 move in the moving direction of the movable die 221 and push the molded product 1 with a set compression force (e.g., pressing force).

In this process, the first sub-ejecting rod 31 of the first sub-ejecting unit 30 moves in the moving direction of the movable die 221 through the first guide bush 35 and pushes the molded product 1 with a set compression force through the first sub-ejecting block 33.

At the same time, the second sub-ejecting rod 51 of the second sub-ejecting unit 50 moves diagonally based on the moving direction of the ejecting plate 10 through the second guide bush 55 and pushes the molded product 1 with a set compression force through the second sub-ejecting block 53.

Here, since the second sub-ejecting rod 51 is connected to the joint module 70 to linearly move and be swingable, the second sub-ejecting rod 51 may be moved in the diagonal direction through the second guide bush 55. At this time, as the second sub-ejecting rod 51 moves in the diagonal direction, the second sub-ejecting block 53 escapes from the undercut portion 3.

As described above, when the main ejecting pins 20, the first sub-ejecting unit 30, and the second sub-ejecting unit 50 push the molded product 1, the molded product 1 is gripped by a robot gripper (not shown). Then, the molded product 1 may be separated from the first sub-ejecting block 33 and the second sub-ejecting block 53 by the robot gripper.

Here, the first gradient portion 43 is provided in the first sub-ejecting block 33, and the second gradient portion 63 is provided in the second sub-ejecting block 53. Due to this, the first sub-ejecting block 33 and the second sub-ejecting block 53 may be easily separated from the molded product 1 even if thermal expansion occurs.

Therefore, the ejecting device 100 for die casting according to an exemplary embodiment of the disclosure may eject the molded product 1 through the sequential processes as described above.

According to the ejecting device 100 for die casting according to an exemplary embodiment of the disclosure as described so far, the molded product 1 may be ejected in multiple directions within a set ejecting angle by the main ejecting pins 20, the first sub-ejecting unit 30, and the second sub-ejecting unit 50.

Therefore, the ejecting device 100 for die casting according to an exemplary embodiment of the disclosure may distribute compression force concentrated on the main ejecting pins 20 through the first sub-ejecting unit 30 and the second sub-ejecting unit 50.

As a result, the ejecting device 100 for die casting according to an exemplary embodiment of the disclosure may prevent damage and breakage of the main ejecting pins 20 due to buckling. Furthermore, the ejecting device 100 for die casting according to an exemplary embodiment of the disclosure may reduce unavailability of the die casting system 200 and minimize the occurrence of defects in the molded product 1.

Meanwhile, the ejecting device 100 for die casting according to an exemplary embodiment of the disclosure may eject the molded product 1 in multiple directions, so that the shape of the undercut portion 3 may be implemented in the molded product 1.

Therefore, the ejecting device 100 for die casting according to an exemplary embodiment of the disclosure may improve the degree of freedom of design of the molded product 1.

Although exemplary embodiments of the disclosure have been described above, the disclosure is not limited thereto, and it is possible to carry out various modifications within the claim coverage, the description of the disclosure, and the accompanying drawings, and such modifications also fall within the scope of the disclosure.

The following reference identifiers may be used in connection with the drawings to describe various features of embodiments of the present disclosure.

| | |
|---|---|
| 1: molded product | 3: undercut portion |
| 10: ejecting plate | 11: ejecting driving source |
| 13: penetration hole | 20: main ejecting pin |
| 30: first sub-ejecting unit | 31: first sub-ejecting rod |
| 31a, 51a: coupling end portion | 31b, 51b: free end portion |

-continued

| | |
|---|---|
| 33: first sub-ejecting block | 35: first guide bush |
| 37: tapping thread | 39: first dowel pin |
| 41: first ejecting surface | 43: first gradient portion |
| 50: second sub-ejecting unit | 51: second sub-ejecting rod |
| 53: second sub-ejecting block | 55: second guide bush |
| 59: second dowel pin | 61: second ejecting surface |
| 63: second gradient portion | 70: joint module |
| 71: fixed block | 73: slider |
| 75: hinge pin | |
| 100: ejecting device for die casting | |
| 110: fixed mold | 111: fixed holder |
| 121: fixed die | 200: die casting system |
| 210: movable mold | 211: movable holder |
| 221: movable die | |

What is claimed is:

1. An ejecting device for die casting for use in ejecting a molded product molded by a fixed die and a movable die, the ejecting device comprising:

an ejecting plate disposed on a movable holder on which the movable die is mounted to be movable forward and backward in a moving direction of the movable die;

a plurality of main ejecting pins disposed on the ejecting plate in the moving direction of the movable die to penetrate through the movable die; and a plurality of sub-ejecting units disposed on the ejecting plate to penetrate through the movable die and disposed to eject the molded product in multiple directions within a set ejecting angle range based on an arrangement direction of the main ejecting pins.

2. The ejecting device of claim 1, wherein at least one first sub-ejecting unit of the plurality of sub-ejecting units is arranged at a first ejecting angle according to the arrangement direction of the main ejecting pins.

3. The ejecting device of claim 2, wherein at least one second sub-ejecting unit of the plurality of sub-ejecting units is disposed at a second ejecting angle inclined in a diagonal direction with respect to the arrangement direction of the main ejecting pins.

4. An ejecting device for die casting, the ejecting device being configured to eject a molded product molded by a fixed die and a movable die, the ejecting device comprising:

an ejecting plate disposed on a movable holder on which the movable die is mounted to be movable forward and backward in a moving direction of the movable die;

a plurality of main ejecting pins disposed on the ejecting plate in the moving direction of the movable die to penetrate through the movable die;

at least one first sub-ejecting unit disposed on the ejecting plate to penetrate through the movable die and disposed at a first ejecting angle according to an arrangement direction of the main ejecting pins;

at least one second sub-ejecting unit disposed on the ejecting plate to penetrate through the movable die and disposed to be inclined at a set second ejecting angle based on the arrangement direction of the main ejecting pins; and a joint module disposed on the ejecting plate and connected to the at least one second sub-ejecting unit so that the at least one second sub-ejecting unit is movable linearly and is swingable according to movement of the ejecting plate.

5. The ejecting device of claim 4, wherein the at least one first sub-ejecting unit comprises:

a first sub-ejecting rod coupled to the ejecting plate by tapping and disposed parallel to the main ejecting pins in a moving direction of the ejecting plate; and a first sub-ejecting block coupled to the first sub-ejecting rod.

6. The ejecting device of claim 5, wherein:

the first sub-ejecting rod has a cross-sectional area larger than cross-sectional areas of the plurality of main ejecting pins; and the first sub-ejecting block has a cross-sectional area larger than the cross-sectional area of the first sub-ejecting rod.

7. The ejecting device of claim 5, wherein:

the first sub-ejecting rod is coupled to the ejecting plate by tapping through a coupling end portion having a tapping thread; and the first sub-ejecting block is coupled to a free end portion of the first sub-ejecting rod through a first dowel pin.

8. The ejecting device of claim 5, wherein the first sub-ejecting block comprises:

a first ejecting surface supporting the molded product; and a first gradient portion having a cross-sectional area gradually decreasing at a set gradient angle in a longitudinal direction of the first sub-ejecting rod on the first ejecting surface.

9. The ejecting device of claim 5, wherein the at least one first sub-ejecting unit further comprises a first guide bush fixed to the movable holder to guide the first sub-ejecting rod.

10. The ejecting device of claim 4, wherein the at least one second sub-ejecting unit comprises:

a first sub-ejecting rod connected to the joint module through a through-hole disposed in the ejecting plate and disposed to be inclined in a diagonal direction in a moving direction of the ejecting plate; and a first sub-ejecting block coupled to the first sub-ejecting rod.

11. The ejecting device of claim 10, wherein:

the first sub-ejecting rod has a cross-sectional area larger than cross-sectional areas of the plurality of main ejecting pins; and the first sub-ejecting block has a cross-sectional area larger than the cross-sectional area of the first sub-ejecting rod.

12. The ejecting device of claim 10, wherein:

the first sub-ejecting rod is coupled to the joint module through a coupling end portion to be movable linearly and to be swingable; and the first sub-ejecting block is coupled to a free end portion of the first sub-ejecting rod through a first dowel pin.

13. The ejecting device of claim 10, wherein the first sub-ejecting block comprises:

a first ejecting surface supporting the molded product; and a first gradient portion having a cross-sectional area gradually decreasing at a set gradient angle in a longitudinal direction of the first sub-ejecting rod on the first ejecting surface.

14. The ejecting device of claim 13, wherein the first sub-ejecting block is disposed on an undercut portion molded in the molded product and is disposed to exit the undercut portion through the first ejecting surface.

15. The ejecting device of claim 10, wherein the at least one second sub-ejecting unit further comprises a first guide bush obliquely fixed to the movable holder to guide the first sub-ejecting rod.

16. The ejecting device of claim 10, wherein the joint module comprises:

a fixed block fixed to the ejecting plate in a position corresponding to the through-hole; and a slider coupled to the fixed block to be slidable in a straight direction and coupled so that the first sub-ejecting rod swings within a set ejecting angle range.

17. The ejecting device of claim 16, wherein the first sub-ejecting rod is swingably coupled to the slider through a hinge pin.

18. A die casting system comprising:

a fixed mold disposed on a base, the fixed mold comprising a fixed holder and a fixed die mounted on the fixed holder;

a movable mold disposed on the base to be movable in a front-rear direction, the movable mold comprising a movable holder and a movable die mounted on the movable holder an ejecting plate disposed on the movable holder to be movable forward and backward in a moving direction of the movable die;

a plurality of main ejecting pins disposed on the ejecting plate in the moving direction of the movable die to penetrate through the movable die through the movable holder; and a plurality of sub-ejecting units disposed on the ejecting plate to penetrate through the movable die via the movable holder and disposed to eject a molded product in multiple directions within a range of ejecting angles set based on an arrangement direction of the main ejecting pins.

19. The die casting system of claim 18, wherein at least one first sub-ejecting unit of the plurality of sub-ejecting units is arranged at a first ejecting angle according to the arrangement direction of the main ejecting pins.

20. The die casting system of claim 19, wherein at least one second sub-ejecting unit of the plurality of sub-ejecting units is disposed at a second ejecting angle inclined in a diagonal direction with respect to the arrangement direction of the main ejecting pins.

* * * * *